United States Patent [19]

Ihama et al.

[11] Patent Number: 4,683,193

[45] Date of Patent: Jul. 28, 1987

[54] PROCESS FOR PRODUCING SILVER HALIDE PHOTOGRAPHIC EMULSION

[75] Inventors: Mikio Ihama; Tadaaki Tani; Hiroshi Ohnishi, all of Kanagawa, Japan

[73] Assignee: Fuji Photo Film Co., Ltd., Kanagawa, Japan

[21] Appl. No.: 714,316

[22] Filed: Mar. 21, 1985

[30] Foreign Application Priority Data

Mar. 21, 1984 [JP] Japan ..... 59-53867

[51] Int. Cl.[4] ..... G03C 1/02; G03C 1/19

[52] U.S. Cl. ..... 430/570; 430/569

[58] Field of Search ..... 430/569, 570

[56] References Cited

U.S. PATENT DOCUMENTS

| | | | |
|---|---|---|---|
| 3,656,962 | 4/1972 | Levy | 430/569 |
| 4,006,025 | 2/1977 | Swank et al. | 430/569 |
| 4,060,419 | 11/1977 | Gerber et al. | 430/570 |
| 4,140,530 | 2/1979 | Trunley et al. | 430/569 |
| 4,183,756 | 1/1980 | Locker | 430/569 |
| 4,225,666 | 9/1980 | Locker et al. | 430/569 |
| 4,474,872 | 10/1984 | Onishi et al. | 430/569 |
| 4,476,220 | 10/1984 | Penfound | 430/570 |

*Primary Examiner*—John L. Goodrow
*Assistant Examiner*—Mukund J. Shah
*Attorney, Agent, or Firm*—Sughrue, Mion, Zinn, Macpeak & Seas

[57] ABSTRACT

A process for producing a spectrally sensitized silver halide photographic emulsion is described, comprising adding a substantially water-insoluble spectral sensitizing dye in an aqueous carrier to an emulsion before completion of the formation of silver halide grains without using an organic solvent.

10 Claims, No Drawings

PROCESS FOR PRODUCING SILVER HALIDE PHOTOGRAPHIC EMULSION

FIELD OF THE INVENTION

This invention relates to a process for producing a spectrally sensitized silver halide photographic emulsion, and more particularly to a process for producing a silver halide emulsion which is sensitized by adding a spectral sensitizing dye during the formation of silver halide grains.

BACKGROUND OF THE INVENTION

In the production of spectrally sensitized silver halide emulsions, sensitizing dyes are usually added to emulsions after the formation of silver halide grains. To the contrary, methods of adding sensitizing dyes to emulsions before completion of the formation of silver halide grains are disclosed in U.S. Pat. Nos. 2,735,766, 3,628,960, 4,183,756 and 4,225,666. In particular, U.S. Pat. Nos. 4,183,756 and 4,225,666 describe that the addition of sensitizing dyes to emulsions before completion of the formation of silver halide grains brings about the advantage of (1) an increase in photographic sensitivity, (2) an increase in stability with respect to the passage of time, (3) prevention of desorption of dyes and color remaining, (4) prevention of variation of light absorption characteristic of dyes, and (5) prevention of change of the crystal habit of the silver halide grains.

Many currently employed sensitizing dyes are substantially water insoluble. Such water-insoluble dyes are generally dissolved in an organic solvent, such as methanol, ethanol, methyl cellosolve, pyridine, etc., and added to an emulsion before coating. To the contrary, it is difficult to add an organic solvent solution of the substantially water-insoluble sensitizing dye to an emulsion before the formation of silver halide grains is completed, for the reasons set forth below. First, since formation of silver halide grains is usually carried out at high temperatures (e.g., 50° to 80° C.), addition of a large quantity of an organic solvent solution of a dye during the formation of grains induces evaporation of a large amount of the organic solvent, which is not only harmful to workers, but also creates a danger of explosion. On the other hand, since an emulsion before coating can be dissolved at a low temperature (e.g., 40° C.), addition of an organic solvent solution of a dye to an emulsion before coating involves little evaporation of the organic solvent. Second, addition of an organic solvent to an emulsion is likely to give rise to problems ascribed to formation of condensates of hydrophilic colloids.

SUMMARY OF THE INVENTION

Accordingly, an object of this invention is to provide an improved process for spectral sensitization which comprises adding a substantially water-insoluble dye to an emulsion before completion of the formation of silver halide grains.

It has now been found that the above-described object of this invention can be achieved by adding a dispersion of a substantially water-insoluble dye in an aqueous medium to an emulsion before completion of the formation of silver halide grains without using an organic solvent.

This process not only provides the above-described advantages (1) to (5) possessed by the methods disclosed in U.S. Pat. Nos. 4,183,756 and 4,225,666, but also unexpectedly provides additional advantages of (6) increasing the rate of development and (7) improving the reciprocity characteristics.

It has been regarded as essential in the photographic art to apply water-insoluble sensitizing dyes as solutions in organic solvents. Therefore, it is an unpredictable finding that water-insoluble sensitizing dyes can be added without using an organic solvent before completion of the formation of silver halide grains, thereby not only ensuring advantages such as a conspicuous increase of photographic sensitivity, but also accomplishing an increase in the rate of development and improvement in the reciprocity law characteristics.

DETAILED DESCRIPTION OF THE INVENTION

The term "substantially water-insoluble sensitizing dyes" as herein used means sensitizing dyes having water solubility of 0.01% by weight or less.

By the expression "to an emulsion" is meant the reaction solution in which silver halide grains are being formed in the form of an emulsion The water-insoluble sensitizing dyes are used in the form of aqueous dispersions. Dispersing of the dyes in an aqueous solvent can be carried out by mechanical or physical pulverization, or by chemical means, such as by the use of surface active agents, or by a combination of such means.

The dispersion may be effected in the presence of a binder, or a binder may be incorporated in a dispersion before addition to an emulsion.

The aqueous solvent which can be used in the present invention consists mainly of water and can contain, if desired, additives, such as a pH adjusting agent, a surface active agent, and the like.

Concentrations of the water-insoluble sensitizing dyes in the aqueous dispersion vary depending on the particular kind of the water-insoluble sensitizing dyes used, the kind of silver halide emulsion used, but usually range from 0.1 to 50 wt %. In the case of using no binder, the concentration preferably ranges from 0.1 to 30 wt %, and more preferably from 0.5 to 10 wt %. With a binder being used, preferred concentrations of the dye are from 1 to 50 wt %.

These dispersions of water-insoluble sensitizing dyes are added to an emulsion before the formation of silver halide grains is completed, in the form of a gel, paste, slurry, etc., and may also be preliminarily dried and then added in the form of a powder.

Mechanical dispersion by pulverizing the substantially water-insoluble sensitizing dye in an aqueous solvent can be performed by means of various dispersing apparatuses, including a high speed stirrer, a ball mill, a sand mill, a colloid mill, an attritor, an ultrasonic dispersing device, etc.

Conditions for effecting the mechanical pulverization and dispersion of the water-insoluble sensitizing dyes vary depending on the particular kinds of dyes to be used, whether or not a dispersing agent is used, but the mechanical dispersion is usually carried out at a temperature of from 40° to 80° C. and at a pH of from 5 to 9.

When no dispersing agent is used, the mechanical pulverization of the substantially water-insoluble spectral sensitizing dye is generally carried out at a temperature of from 60° to 80° C. and at a pH of from 6 to 8, and preferably from 65° C. to 75° C. and at a pH of from 6.5 to 7.5. The pH adjustment can be conducted by the addition of a pH adjusting agent, e.g., potassium hydroxide, sodium hydroxide, acetic acid, phosphoric acid, sulfuric acid, or the like.

The substantially water-insoluble spectral sensitizing dye preferably has a mean grain size (diameter) of 1 μm or less, and more preferably from 1 to 0.1 μm.

The term "diameter" of the substantially water-insoluble spectral sensitizing dye as used herein refers to that of the grain when it is deemed spherical.

Methods for adding the substantially water-insoluble dye to an emulsion typically include (i) a method comprising dispersing the dye in water with the aid of a dispersing agent (i.e., a surface active agent) and adding the dispersion to an emulsion as is, or adding a powder obtained by drying the dispersion; (ii) a method comprising homogenizing the dye and a dispersing agent with a binder, e.g., gelatin, to obtain a homogenate in the form of gel, paste, slurry, or the like and adding the homogenate to an emulsion; (iii) a method comprising drying a dispersion and adding the resulting particles to an emulsion; (iv) a method comprising pulverizing the dye in water without the aid of a dispersing agent into fine particles of 1 μm or less, wherein a binder, e.g., gelatin, may be used, and adding the resulting dispersion to an emulsion.

Unlike the conventional methods as described, e.g., in Japanese Patent Application (OPI) Nos. 110012/77 (corresponding to U.S. Pat. Nos. 4,087,631) and 102733/78 (corresponding to U.S. Pat. No. 4,140,530) (the term "OPI" as used herein refers to a "published unexamined Japanese Patent application"), U.S. Pat. No. 4,006,025 and Japanese patent Application (OPI) No. 105141/83 (corresponding to U.S. Pat. No. 4,474,872) which are characterized by adding a substantially water-insoluble dye to a silver halide emulsion after completion of the formation of silver halide grains, the present invention is characterized by adding a substantially water-insoluble dye to a silver halide emulsion before completion of the formation of silver halide grains, whereby the above-mentioned advantages (1) through (4), can be markedly heightened without encountering with the abovedescribed disadvantages (a) and (b), and also additional advantages (5) and (6) as described above can be obtained.

Of the above-recited method for adding the dye to an emulsion, the method (iv) is characterized in that dispersion of a substantially water-insoluble spectral sensitizing dye in an aqueous solvent can be achieved without any organic solvent by using neither binder nor dispersing agent that has conventionally been considered necessary in such dispersion.

The dispersion obtained by the present invention can be added directly to a silver halide emulsion before completion of the formation of silver halid grains. Alternatively, sufficient photographic properties can also be obtained by once mixing the dispersion with a protective colloid and then adding the resulting solution or gel to the emulsion.

It is also possible for the mixture of the dispersion and a protective colloid to be preserved for a long time at low temperatures, e.g., below 30° C., or in a refrigerator and added, upon use, to a silver halide emulsion before completion of the silver halide grain formation.

The stage at which the above-described dispersion of a substantially water-insoluble sensitizing dye be added to a silver halide emulsion can arbitrarily be selected depending on the kinds of the sensitizing dye and emulsion used as long as the addition is effected before completion of the formation of silver halide grains. For example, the whole amount of the dispersion can be added to a reaction solution simultaneously with or before the start of the formation of grains, or the dispersion can be added in several divided portions. In the latter case, divided portions of the dispersion can be added at an appropriate interval from the start of the formation of grains through the subsequent process of the grain formation. Further, the dispersion may be added continuously. Such being the case, the addition can be started simultaneously with or before the start of the formation of grains, if desired, together with the addition of a silver nitrate solution, a halogen solution or the like, or after the start of the formation of grains. Furthermore, the dispersion of the sensitizing dye may be added continuously or intermittedly during a process of allowing seed crystals to grow.

The substantially water-insoluble sensitizing dyes which can be used in the present invention can be conventional substantially water-insoluble spectral sensitizing dye, including, for example, methine dyes and styryl dyes, such as cyanine dyes, merocyanine dyes, hemicyanine dyes, rhodacyanine dyes, oxonol dyes, hemioxonal dyes, etc.

In the above-described substantially water-insoluble sensitizing dyes, cyanine dyes are particularly useful.

Specific examples of cyanine dye which can be used in the present invention include dyes having the following formula (I).

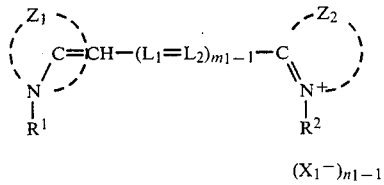

Formula (I)

In formula (I), $Z_1$ and $Z_2$ each represents atoms to complete a heterocyclic nucleus of the type usually present in cyanine dyes, such as thiazole, thiazoline, benzothiazole, naphthothiazole, oxazole, oxazoline, benzoxazole, naphthoxazole, tetrazole, pyridine, quinoline, imidazoline, imidazole, benzimidazole, naphthoimidazole, selenazoline, selenazole, benzoselenazole, naphthoselenazole, indolenine, or like nucleus. These nuclei each may be substituted with a lower alkyl group like methyl, a halogen atom, a phenyl group, a hydroxyl group, an alkoxy group containing from 1 to 4 carbon atoms, a carboxyl group, an alkoxycarbonyl group, an alkylsulfamoyl group, an alkylcarbamoyl group, an acetyl group, an acetoxy group, a cyano group, a trichloromethyl group, a trifluoromethyl group, a nitro group, and so on.

$L_1$ and $L_2$ each represents a methine group or a substituted methine group. Suitable substituted methine groups include those substituted with a lower alkyl group like methyl, ethyl, etc., a phenyl group, a substituted phenyl group, a methoxy group, an ethoxy group, and so on.

$R_1$ and $R_2$ each represents an alkyl group containing from 1 to 5 carbon atoms, a substituted alkyl group having a carboxyl group, a substituted alkyl group having a sulfo group such as β-sulfoethyl, γ-sulfopropyl, δ-sulfobutyl, 2-(3-sulfopropoxy)ethyl, 2-[2-(3-sulfopropoxy)ethoxy]ethyl, 2-hydroxy.sulfopropyl, etc., an allyl group or other substituted alkyl group of the type which is usually employed as a group to be substituted at the nitrogen position of cyanine dyes. $m_1$ represents 1, 2 or 3. $X_1^-$ represents an acid anion group of the type conventionally employed for cyanine dyes, such as iodine ion, bromine ion, p-toluenesulfonic acid ion, perchloric acid ion, or so on. $n_1$ represents 1 to 2, and $n_1$ is 1 when the dye has a betaine structure.

Further, typical examples of the compounds represented by formula (I) of the present invention are illustrated below.

Dye 1

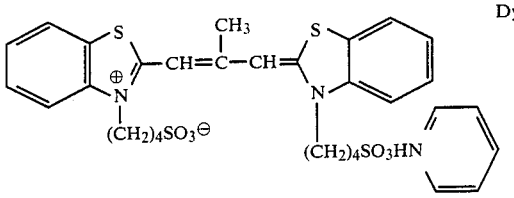

Dye 2

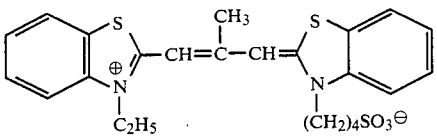

Dye 3

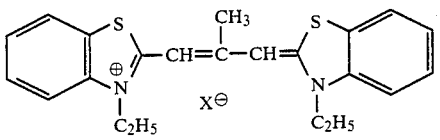

Dye 4

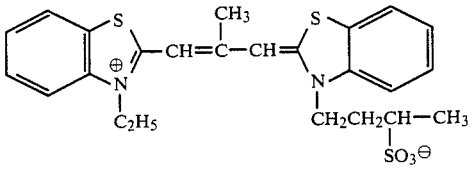

Dye 5

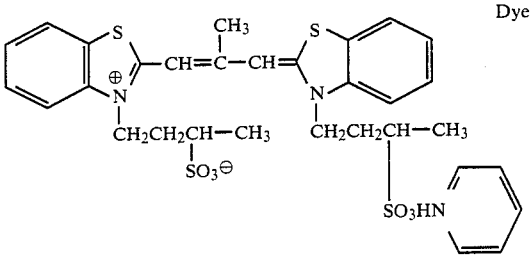

Dye 6

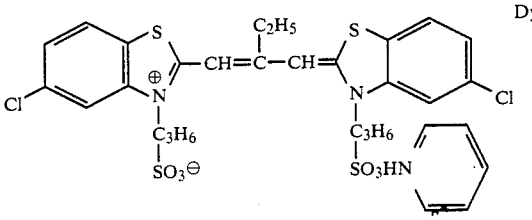

Dye 7

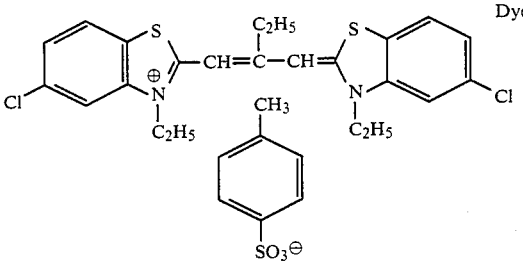

Dye 8

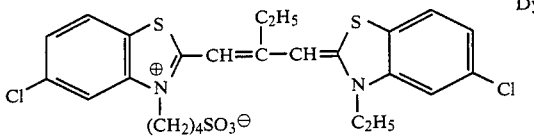

Dye 9

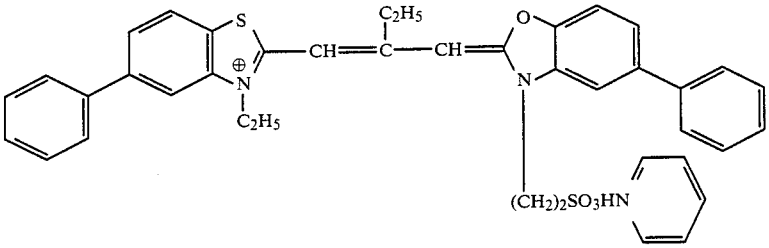

Dye 10

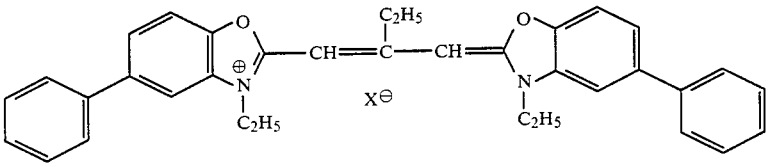

-continued

Dye 11

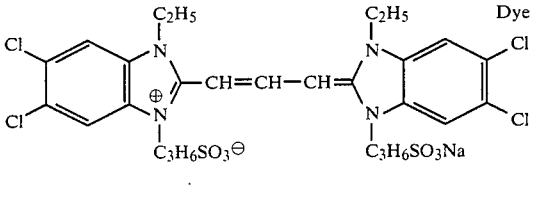

Dye 12

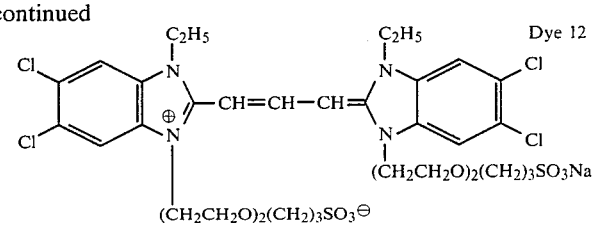

Dye 13

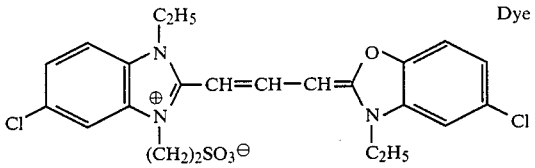

Dye 14

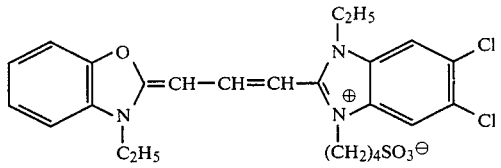

Dye 15

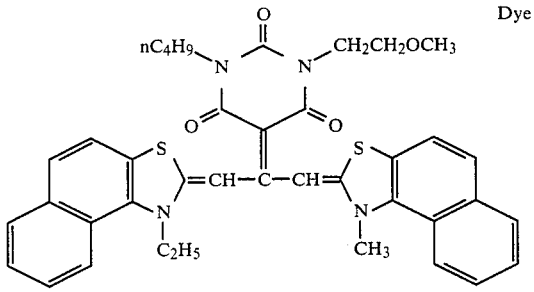

Of these dyes, anionic dyes containing, for example, at least one, and preferably two or more, sulfo groups or sulfoalkyl groups in the molecule, are particularly effective.

Specific examples of employable spectral sensitizing dyes are those described in the above-recited references, and, in addition, those described in German Pat. No. 929,080, U.S. Pat. Nos. 2,493,748, 2,503,776, 2,519,001, 2,912,329, 3,656,959, 3,672,897, 3,694,217, 4,025,349, 4,046,572, 2,688,545, 2,977,229, 3,397,060, 3,522,052, 3,527,641, 3,617,293, 3,628,964, 3,666,480, 3,672,898, 3,679,428, 3,703,377, 3,814,609, 3,837,862 and 4,026,707, British Pat. Nos. 1,242,588, 1,344,281 and 1,507,803, Japanese Patent Publication Nos. 4936/68, 14030/69, 24844/77 and 12375/78, and Japanese Patent Application (OPI) Nos. 80827/75, 110618/77, 109925/77, etc.

The amount of the substantially water-insoluble sensitizing dye to be added during the preparation of a silver halide emulsion varies depending upon the kinds of additives, the amount of silver halides and the like, but is usually employed in substantially the same range as would be employed in a conventional method.

More specifically, the amount of the sensitizing dye to be added preferably ranges from 0.01 to 10 mmol, and more preferably from 0.1 to 1 mmol, per mol of silver halide.

Examples of dispersing agents which can be used in the present invention include an alkylallyl sulfonate having at least 18 carbon atoms, and oligomers and polymers thereof. Specific examples of such a dispersing agent include an alkali metal salt of triisopropylnaphthalenesulfonic acid or di-sec-butylnaphthalenesulfonic acid and a condensation product of naphthalene or ditolyl ether, formaldehyde, and sulfuric acid or lignin sulfonic acid.

Other examples of dispersing agents which can be used in the present invention include urea or thiourea derivatives, saturated or unsaturated mono- or dicarboxylic acid amides, lactams, acid imides or derivatives thereof, oximes, saturated containing an oxygen atom, a sulfur atom, a carbonyl group or an imino group in their ring or these heterocyclic compounds having a substituent, such as a hydroxyl group, an amido group, a halogen atom, an alkyl group of from 1 to 4 carbon atoms, a phenyl group, or a hydroxyalkyl group of from 1 to 4 carbon atoms, at an optional position, polyhydric aliphatic or aromatic alcohols, polyalkylene glycols, carbamic acid esters, and benzene derivatives. The polyhydric aliphatic or aromatic alcohols specifically include 2,2-dimethyl- or 2,2-diethyl-1,3-propanediol, dihydroxyacetone, o-oxylene glycol, erythritol, D-fructose, maltose, lactose, xylitol, sorbitol and mannitol.

The amount of the dispersing agent to be used according to the process of the present invention can vary widely, for example, ranging from 1 to 80% by weight based on the total weight of the dispersion, and depends on the properties of the dispensing agent used and the particular dye. Usually, from 0.1 to 3 parts by weight of the dispersing agent will be sufficient per 1 part by weight of the dye. More than 3 parts by weight of the dispersing agent may also be used.

The binder or protective colloid which can be used in the present invention advantageously includes gelatin, but other hydrophilic colloids may also be employed. Examples of the other hydrophilic colloids include proteins, such as gelatin derivatives, graft copolymers of gelatin and other high polymers, albumin, casein, etc.; cellulose derivatives, such as hydroxyethyl cellulose, carboxymethyl cellulose, cellulose sulfate, etc.; sugar derivatives, such as sodium alginate, starch derivaties, etc.; and a wide variety of synthetic hydrophilic high polymers, such as homopolymers, e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc., and copolymers composed of the monomers which constitute the above-described homopolymers Examples of the gelatin which can be used are acid-processed gelatin, enzyme-processed gelatin as described in *Bull. Soc. Sci. Phot. Japan*, No. 16, 30 (1966), and hydrolysis products and enzymatic decomposition products of gelatin. The gelatin derivatives which can be used include those obtained by reacting gelatin with various kinds of compounds, such as acid halides, acid anhydrides, isocyanates, bromoacetic acid, alkane sulfones, vinylsulfonamides, maleinimide compounds, polyalkylene oxides, epoxy compounds, and the like. Specific examples thereof are described in U.S. Pat. Nos. 2,614,928, 3,132,945, 3,186,846 and 3,312,553, British Pat. Nos. 861,414, 1,005,784 and 1,033,189, Japanese Patent Publication No. 26845/67.

The foregoing gelatin graft polymers include graft polymers formed by grafting a homo- or copolymer of a vinyl monomer, such as acrylic acid, methacrylic acid or derivatives thereof, e.g., esters, amides, etc., acrylonitrile, styrene, etc., to gelatin. In particular, graft polymers formed by grafting a polymer having compatibility with gelatin to some extent, such as a polymer of acrylic acid, methacrylic acid, acrylamide, methacrylamide, hydroxyalkyl methacrylate, etc., to gelatin are preferred. Examples of these graft polymers are described, e.g., in U.S. Pat. Nos. 2,763,625, 2,831,767, 2,956,884, etc.

These binders are usually used at a concentration of from 1 to 50% by weight in the dispersion.

These protective colloids can be added as an aqueous solution or as a solid. Further, when the protective colloid is added, a known preservative may be used if desired.

Silver halides in silver halide emulsions to which the present invention is applied may be any of silver bromide, silver iodobromide, silver iodochlorobromide, silver chlorobromide, silver chloride and the like. The grain size of silver halide grains in the emulsion is not particularly restricted.

Silver halide photographic emulsion to be used in the present invention can easily be prepared according to the processes described, e.g., in P. Glafkides, *Chimie et Physique Photographique*, Paul Montel (1967), G. F. Duffin, *Photographic Emulsion Chemistry*, The Focal Press (1966), V. L. Zelikman et al., *Making and Coating Photographic Emulsion*, The Focal Press (1964), etc. More specifically, photographic emulsions can be prepared according to any of the acid process, the neutral process, the ammonia process. Methods for reacting a soluble silver salt with a soluble halogen salt include a single jet method, a double jet method, and a combination thereof.

A method in which silver halide grains are produced in the presence of excess silver ions (the so-called reverse mixing method) can also be employed. Further, the so-called controlled double jet method, in which the pAg of the liquid phase wherein silver halide grains are to be formed is maintained constant, may also be employed.

In the process of forming silver halide grains or physical ripening, cadmium salts, zinc salts, lead salts, thallium salts, iridium salts or complexes thereof, rhodium salts or complexes thereof, iron salts or complexes thereof, and the like may be coexisted.

After the formation of grains completes, i.e., after the precipitation of grains or physical ripening, soluble salts are usually removed from the emulsion by the conventionally known noodle washing method, in which gelatin is gelled, or a sedimentation (flocculation) process using an inorganic salts composed of a polyvalent anion, e.g., sodium sulfate, an anionic surface active agent, an anionic polymer, e.g., polysytrenesulfonic acid, or a gelatin derivative, e.g., aliphatic acylated gelatin, aromatic acylated gelatin, aromatic carbamoylated gelatin, etc.

Typically, the silver halide emulsion is chemically sensitized. Chemical sensitization can be carried out using processes as described, e.g., in H. Frieser, Ed., *Die Grudlagen der Photograpischen Prozesse mit Silberhalogeniden*, pp. 675–734, Akademische Verlagsgesellschaft (1968).

More specifically, chemical sensitization of the photographic emulsions can be effected by sulfur sensitization using compounds containing sulfur capable of reacting with active gelatin or silver ions (e.g., thiosulfates, thioureas, mercapto compounds, rhodanine, etc.), reduction sensitization using reducing materials (e.g., stannous salts, amines, hydrazine derivatives, formamidinesulfinic acid, silane compounds, etc.), noble metal sensitization using noble metal compounds (e.g., gold complexes, and complexes of Periodic Table Group VIII metals, such as Pt, Ir, Pd, etc.) or combinations thereof.

For the purpose of preventing fog in preparation, storage, or photographic processing, or for stabilizing photographic properties, the photographic emulsions used in the present invention can contain various compounds. Specific examples of such compounds include azoles, such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole), etc.; mercaptopyrimidines; mercaptotriazines; thioketo compounds, such as oxazolinethione, etc.; azaindenes, such as triazaindenes, tetraazaindenes (particularly 4-hydroxy-substituted (1,3,3a,7)tetraazaindenes), pentaazaindenes, etc.; benzenethiosulfonic acid; benzenesulfinic acid; benzenesulfonic acid amide; and many other compounds known as anti-foggants or stabilizers.

In addition to the spectral sensitization of photographic emulsions before completion of the silver halide grain formation, the emulsion may also be spectrally sensitized with methine dyes and others not only before coating on an appropriate support, but in a chemical ripening process, etc. Such being the case, the dyes to be used include cyanine dyes, merocyanine dyes, complex cyanine dyes, complex merocyanine dyes, holopolar cyanine dyes, hemicyanine dyes, styryl dyes and hemioxonal dyes, with cyanine dyes, merocyanine dyes, and complex merocyanine dyes being particularly useful. These dyes can have any of the basic heterocyclic nuclei commonly employed in cyanine dyes.

The photographic emulsion may further contain, in addition to the sensitizing dyes, a dye which, per se, exhibits no spectral sensitizing activity, or a compound which does not substantially absorb visible light, but which shows supersensitizing activity when used in combination with the sensitizing dye. Examples of such dyes and compounds include aminostyrl compounds substituted with a nitrogen-containing heterocyclic group, as disclosed in U.S. Pat. Nos. 2,933,390 and 3,635,721, aromatic organic acid-formaldehyde condensation products, as disclosed in U.S. Pat. No. 3,743,510, cadmium salts, azaindene compounds, and the like. The combinations described in U.S. Pat. Nos. 3,615,613, 3,615,641, 3,617,295 and 3,635,721 are particularly useful.

The silver halide emulsions which can be used in the present invention can further contain a wide variety of additives, such as a surface active agent, a hardener, a viscosity-imparting agent, a dye, an ultraviolet absorbing agent, an antistatic agent, a brightening agent, a desensitizer, a developing agent, a discoloration preventing agent, a mordant, and the like. In addition, couplers, e.g., color couplers, can be used as dispersed in oils.

Details for these additives are described in *Research Disclosure* (RD-17643), Vol. 176, 22–31 (Dec., 1978), T. H. James (ed.), *The Theory of the Photographic Process*, 4th Ed., pp. 396–399, Macmillan Publishing Co., Inc. (1977), etc.

Binders which can be used in the silver halide emulsion according to the present invention include gelatin to advantage, and gelatin derivatives, e.g., phthalated gelatin, albumin, agar, gum arabic, cellulose derivatives, polyvinyl acetate, polyacrylamide, polyvinyl alcohol, and the like.

The present invention is now illustrated in greater detail by reference to examples, but it is to be understood that these examples do not limiting the present invention. In the examples, all percents are by weight unless otherwise indicated.

EXAMPLE 1

To 285.6 g of water was added 10.4 g of Spectral Sensitizing Dye A having the following formula, and the solution was adjusted to a pH of 7.0 with a 0.1N aqueous solution of sodium hydroxide.

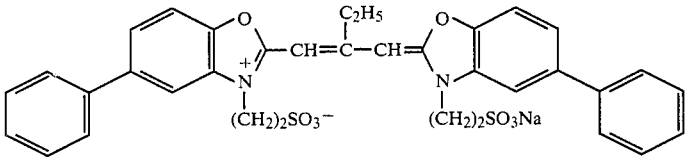

The aqueous solution was heated to 65° C. and stirred for 90 minutes at 8,000 rpm by means of a high speed stirrer (a dissolver) to obtain a dispersion having dispersed therein the spectral sensitizing dye.

To the resulting dispersion was added 1,600 g of a 6.25% gelatin aqueous solution. After stirring at 1,000 rpm for 30 minutes, the mixture was filtered through a filter having a pore size of 30 μm.

The resulting dispersion of Dye A was subjected to the following tests.

Test No. 1

1000 ml of water, 30 g of inactive gelatin, 15 ml of a 50% aqueous solution of ammonium nitrate and 7.5 ml of a 25% aqueous ammonia were charged in a reactor, and 750 ml of a 1N aqueous solution of silver nitrate, and a 1N aqueous solution of potassium bromide were added simultaneously to the mixture over a period of 40 minutes while maintaining the mixture at 50° C. while stirring, to thereby prepare an emulsion containing cubic silver bromide grains having an average edge length of 0.7 μm. The silver potential of the solution during the reaction was always maintained at +50 mV VS SCE (saturated calomel electrode) at 50° C. The resulting emulsion was desalted, and gelatin and water were added thereto. The mixture was adjusted so as to have a pH value of 6.5 and a pAg value of 8.3 at 50° C. and was made up to 2,000 ml. An aqueous solution of sodium thiosulfate was added to the emulsion, and the emulsion was allowed to ripen at 50° C. for 60 minutes to effect sulfur sensitization. The amount of the sodium thiosulfate to be added was determined so as to produce the highest photographic sensitivity when exposed to light for 1 second.

To the resulting emulsion was added 50 ml of the above prepared dispersion of Dye A, and the mixture was allowed to ripen at 40° C. for 20 minutes while stirring. A coating aid and a hardener were then added thereto, and the resulting coating emulsion was coated on a cellulose triacetate film base to a silver bromide coverage of 7 g/m$^2$. The sample thus produced was exposed to light emitted from a tungsten lamp (color temperature: 2854 K) through a color filter (trade mark: SC 52 or BPN 42, produced by Fuji Photo Film Co., Ltd.) and a continuous wedge for one second. The exposed sample was developed with a surface developer (MAA-1) having the following composition at 20° C. for 10 minutes.

| Composition of Surface Developer: | |
|---|---|
| Metol | 2.5 g |
| d-Ascorbic acid | 10.0 g |
| Potassium bromide | 1.0 g |
| Kodalk (produced by Eastman Kodak Co.) | 35.0 g |
| Water to make | 1,000 ml |

Test No. 2

The same procedures as described in Test No. 1 were repeated, except that 50 ml of the dispersion of Dye A was divided in 10 portions, and each 5 ml portion was added to the emulsion at the start of the addition of the silver nitrate aqueous solution and potassium bromide aqueous solution, and thereafter every 4 minutes (i.e., after 4, 8, 12, 16, 20, 24, 28, 32 and 36 minutes from the start of the addition of the solutions).

Photographic sensitivities obtained per Test Nos. 1 and 2 are shown in Table 1.

TABLE 1

| Test No. | Relative Sensitivity | |
|---|---|---|
| | BPN 42 Filter | SC 52 Filter |
| 1 (Comparison) | 100 (standard) | 100 (standard) |
| 2 (Invention) | 198 | 250 |

It can be seen from Table 1 that Test No. 2, in accordance with the present invention, produced very high sensitivities as compared with the results of Test No. 1 according to the conventional method. Further, it was also found that the emulsion prepared in Test No. 2 was superior in stability with the passage of time to the emulsion of Test No. 1.

Test No. 3

Each of the samples obtained in Test Nos. 1 and 2 was exposed to light emitted from a tungsten lamp (color temperature; 2854 K) through a continuous wedge for one second. The exposed sample was developed with MAA-1 developer as used above at 20° C. for a varied time. The rate of development was determined at an exposure that gives an optical density of a straight line portion of a characteristic curve when the development was conducted for 16 minutes. The rate of development of the emulsion of Test No. 1 was found to be 0.14 $min^{-1}$, and that of the emulsion of Test No. 2 was found to be 0.25 $min^{-1}$. These results indicate that Test No. 2 according to the present invention achieved in increased rate of development over the conventional method. The expression "rate of development" as herein used refers to the reciprocal of the development time required for reaching an optical density of one-half that obtained by 16-minute development.

Test No. 4

Each of the emulsions obtained in Test Nos. 1 and 2 was exposed to light emitted from a tungsten lamp (color temperature: 4800 K) through a continuous wedge and an SC 52 filter for 1, 1/10, or 1/100 second, and then exposed by means of EG & G Sensitometer (manufactured by DEGERTON, GERMESHAUSEN & GRIER, Inc.) for 1/100, 1/1,000, 1/10,000, 1/100,000 or 1/1,000,000 second. The exposed sample was developed with MAA-1 developer for 10 minutes at 20° C., and the optical density was measured to determine sensitivity. The results obtained are shown in Table 2.

TABLE 2

| Exposure Time | Relative Sensitivity Test No. 1 | Test No. 2 |
|---|---|---|
| 1 | 100 (standard) | 250 |
| 1/10 | 100 | 240 |
| 1/100 | 93 | 208 |
| 1/1,000 | 83 | 208 |
| 1/10,000 | 40 | 135 |
| 1/100,000 | 41 | 129 |
| 1/1,000,000 | 35 | 126 |

From the results shown in Table 2, it can be seen that the emulsion of Test No. 2 (Invention) not only has higher sensitivity when exposed for a long time (1 second) but also undergoes less reduction in sensitivity when exposed for a short exposure time as compared with the emulsion of Test No. 1 (Comparison), indicating superiority in reciprocity law characteristics over the emulsion of Test No. 1.

EXAMPLE 2

A dispersion of a spectral sensitizing dye was prepared in the same manner as described in Example 1 except for using Dye B having the following formula in place of Dye A.

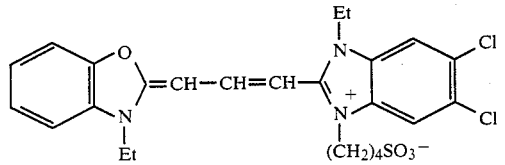

The thus prepared dispersion of Dye B was subjected to the following tests.

Test No. 5

In the same manner as in Example 1, an emulsion comprising tetradecahedral silver iodobromide grains (silver iodide content: 1.5 mol %) having an average edge length of 0.65 μm was prepared. During the reaction, the silver potential of the reaction solution was maintained at +10 mV at 50° C. An aqueous solution of sodium thiosulfate and an aqueous solution of chloroauric acid were added to the emulsion, followed allowing the emulsion to ripen at 55° C. for 100 minutes to effect gold-sulfur sensitization. The amounts of the sodium thiosulfate and chloroauric acid were determined so as to produce the highest photographic sensitivity when exposed to light for 1/100 second.

To the resulting emulsion was added 25 ml of the above prepared dispersion of Dye B, and the mixture was allowed to ripen at 40° C. for 20 minutes while stirring well. A coating aid and a hardener were then added thereto, and the resulting coating emulsion was coated on a cellulose triacetate film base to provide a silver iodobromide coverage of 1.3 $g/m^2$. The sample thus prepared was exposed to light emitted from a tungsten lamp (color temperature: 2854 K) through a continuous wedge for 1/100 second. The exposed sample was developed with a surface developer consisting of phenidone and hydroquinone at 32° C. for 24 seconds.

Test No. 6

The same procedures as in Test No. 5 were repeated except that 25 ml of the dispersion dye B was divided in 5 portions and each 5 ml portion was added to the emulsion at the start of the addition of the silver nitrate aqueous solution and potassium bromide aqueous solution, and thereafter every 8 minutes (i.e., after 8, 16, 24 and 32 minutes from the start of the addition of the solutions).

Photographic sensitivities obtained per Test Nos. 5 and 6 are shown in Table 3.

TABLE 3

| Test No. | Relative Sensitivity |
|---|---|
| 5 (Comparison) | 100 (standard) |
| 6 (Invention) | 300 |

As is shown in Table 3, a very high sensitivity was obtained in Test No. 6 based on the present invention as compared with Test No. 5 according to the conventional method.

Further, the emulsion obtained in Test No. 6 was superior to that of Test No. 5 in terms of development progressiveness, reciprocity law characteristics, and the like.

EXAMPLE 3

Two hundreds grams of Sensitizing Dye C having the following formula was pulverized in a ball mill together with 3,400 mg of sorbitol and 40 mg of sodium lauryl sulfate. The mixture was mixed with 400 mg of a 10% aqueous gelatin solution, and the resulting paste was passed through a net having 1 mm meshes to form noodles, which were then dried in hot air.

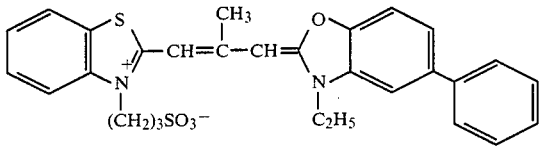

Test No. 7

The same procedures as described in Test No. 1 were repeated except for replacing the dispersion of Dye A with an equimole of the above prepared noodles of Dye C.

Test No. 8

The same procedures as described in Test No. 2 were repeated except from replacing the dispersion of Dye A with an equimole of the above prepared noodles of Dye C.

Photographic sensitivities obtained per Test Nos. 7 and 8 are shown in Table 4.

TABLE 4

| Test No. | Relative Sensitivity | |
|---|---|---|
| | BPN 42 Filter | SC 52 Filter |
| 7 (Comparison) | 100 (standard) | 100 (standard) |
| 8 (Invention) | 220 | 240 |

As shown in Table 4, Test No. 8 according to the present invention attained a very high sensitivity value as compared with Test No. 7 according to the conventional method.

Further, it was found that the emulsion obtained in Test No. 8 was superior to that of Test No. 7 in terms of stability with the passage of time.

EXAMPLE 4

Fifty grams of a dry powder of a cyanine dye, anhydro-5,6-dichloro-1,3-diethyl-3'-(4''-sulfobutyl)benzimidazolothiacarbocyanine hydroxide (Dye D), was wetted with 16.6 g of a 15% aqueous solution of Daxad 11 KLS, and 433.3 g of water was added thereto to form a slurry. The slurry was homogenized by a homogenizer to form a 10% dye dispersion. The dispersion was diluted to 0.39% upon use by adding 6,110 g of water and 264 g of a 10% aqueous solution of potassium sulfate.

Test No. 9

The same procedures as described for Test No. 1 were repeated except for using an equimolar amount of the above prepared dispersion of Dye D in place of the dispersion of Dye A.

Test No. 10

The same procedures as described for Test No. 2 were repeated except for using an equimolar amount of the above prepared dispersion of Dye D in place of the dispersion of Dye A.

Photographic sensitivities obtained in Test Nos. 9 and 10 are shown in Table 5.

TABLE 5

| Test No. | Relative Sensitivity | |
|---|---|---|
| | BPN 42 Filter | SC 52 Filter |
| 9 (Comparison) | 100 (standard) | 100 (standard) |
| 10 (Invention) | 190 | 205 |

TABLE 5-continued

As shown in Table 5, Test No. 10 according to the present invention attained a very high sensitivity value as compared with Test No. 9 according to the conventional method.

Further, it was also found that the emulsion prepared in Test No. 10 was superior to that of Test No. 8 in terms of stability with the passage of time.

While the invention has been described in detail and with reference to specific embodiments thereof, it will be apparent to one skilled in the art that various changes and modifications can be made therein without departing from the spirit and scope thereof.

What is claimed is:

1. A process for producing a spectrally sensitized silver halide photographic emulsion comprising adding a substantially water-insoluble organic spectral sensitizing dye in an aqueous medium to an emulsion before completion of the formation of silver halide grains without using an organic solvent, wherein said substantially water-insoluble organic spectral sensitizing dye has a water solubility of 0.01% by weight or less.

2. A process for producing a spectrally sensitized silver halide photographic emulsion as in claim 1, wherein the substantially water-insoluble organic spectral sensitizing dye is used in the form of particles having a mean grain size of 1 μm or less.

3. A process for producing a spectrally sensitized silver halide photographic emulsion as in claim 1, wherein the substantially water-insoluble organic spectral sensitizing dye is used in the form of particles having a mean grain size of from 1 to 0.1 μm.

4. A process for producing a spectrally sensitized silver halide photographic emulsion as in claim 1, wherein the substantially water-insoluble organic dye is dispersed in water with the aid of dispersing agent, and the resulting dispersion is added to the emulsion.

5. A process for producing a spectrally sensitized silver halide photographic emulsion as in claim 4, wherein the dispersion is dried to a powder form before addition to the emulsion.

6. A process for producing a spectrally sensitized silver halide photographic emulsion as in claim 1, wherein the substantially water-insoluble organic dye and a dispersing agent are homogenized with a binder, and the resulting homogenate is added to the emulsion.

7. A process for producing a spectrally sensitized silver halide photographic emulsion as in claim 1, wherein the substantially water-insoluble organic dye is pulverized in water without the aid of a dispersing agent into fine particles of 1 μm or less, and added directly to the emulsion.

8. A process for producing a spectrally sensitized silver halide photographic emulsion as in claim 1, wherein the substantially water-insoluble organic dye is an anionic dye containing at least one sulfo group or sulfoalkyl group.

9. A process for producing a spectrally sensitized silver halide photographic emulsion as in claim 1, wherein said substantially water-insoluble organic spectral sensitizing dye is a cyanine dye or a merocyanine dye.

10. A process for producing a spectrally sensizited silver halide photographic emulsion as in claim 1, wherein said substantially water-insoluble organic spectral sensitizing dye is a cyanine dye represented by the formula (I):

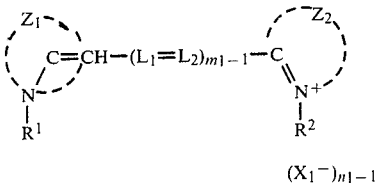

wherein $Z_1$ and $Z_2$ each represents a heterocyclic mucleus; $L_1$ and $L_2$ each represents a methine group or a substituted methine group; $R_1$ and $R_2$ each represents an alkyl group, a substituted alkyl group or an allyl group; $m_1$ represents 1, 2 or 3; $X_1$ represents an acid anion group; and $N_1$ represents 1 or 2.

* * * * *